US006354685B1

(12) United States Patent
Ohashi

(10) Patent No.: US 6,354,685 B1
(45) Date of Patent: Mar. 12, 2002

(54) DRIVING DEVICE AND DRIVING METHOD OF ON-DEMAND INK JET PRINTER HEAD

(75) Inventor: Shiro Ohashi, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/478,744

(22) Filed: Jan. 6, 2000

(30) Foreign Application Priority Data

Jan. 12, 1999 (JP) ..... 11-005746

(51) Int. Cl.[7] ..... B41J 29/38; B41J 2/045

(52) U.S. Cl. ..... 347/11; 347/9; 347/10; 347/68

(58) Field of Search ..... 347/9, 10, 11, 347/15, 94

(56) References Cited

FOREIGN PATENT DOCUMENTS

| | | | |
|---|---|---|---|
| EP | 0829354 | 3/1998 | ..... B41J/2/045 |
| JP | 57-61576 | 4/1982 | ..... B41J/3/04 |
| JP | 9-30007 | 2/1997 | ..... B41J/2/175 |
| JP | 11058719 A * | 3/1999 | ..... B41J/2/01 |

* cited by examiner

*Primary Examiner*—John Barlow
*Assistant Examiner*—Alfred Dudding
(74) *Attorney, Agent, or Firm*—Ostrolenk, Faber, Gerb & Soffen, LLP

(57) ABSTRACT

In an on-demand ink jet printer head for discharging minute ink drops by means of meniscus position control and acoustic wave control, the length of each discharge pause period with respect to each orifice of the printer head is determined based on image data, and a pre-discharge waveform is determined for each discharge pause period based on the length of the discharge pause period. The pre-discharge waveform is applied to a piezoelectric element before restart of ink drop discharge by the movement of the piezoelectric element, thereby a large displacement which is designed depending on the length of the discharge pause period is given to ink before the restart of the ink drop discharge so that the ink will be moved and stirred, thereby uniformity and stability of ink drop discharge properties (size, speed, flying direction, etc.) are realized at the restart after the discharge pause period. Continuous meniscus vibration is not employed for maintaining ink viscosity during the discharge period.

54 Claims, 8 Drawing Sheets

DRIVING DEVICE AND DRIVING METHOD OF ON-DEMAND INK JET PRINTER HEAD

BACKGROUND OF THE INVENTION

The present invention relates to a driving device and a driving method of an on-demand ink jet printer head, and in particular, to a driving device and a driving method of an on-demand ink jet printer head by which discharge of minute ink drops from orifices of the printer head can be executed correctly and stably according to image data, and thereby high quality printed output can be obtained with high stability.

DESCRIPTION OF THE PRIOR ART

Ink jet printers are generally classified into two types according to their ink drop discharging method: continuous ink jet printers and on-demand ink jet printers. In a continuous ink jet printer, the printer head constantly discharges ink drops continuously and only ink drops necessary for generating images are allowed to reach an object such as paper. In an on-demand ink jet printer, the printer head selectively discharges ink drops which are necessary for generating images.

The on-demand ink jet printer head is generally provided with orifices (nozzles) for discharging ink drops and a mechanism for controlling the discharging operation of the printer head from the orifices according to image data. In the on-demand ink jet printer head, a pressure generation means is generally provided to each ink chamber corresponding to an orifice, and ink drops are discharged from each orifice onto the object such as paper due to acoustic waves which are generated by the pressure generation means corresponding to the orifice. In the ink drop discharging method using the pressure generation means, at least a part of walls of the ink chamber is deformed by an electric-mechanic transducer (actuator) so as to generate acoustic waves, and ink drops are discharged by the acoustic energy of the acoustic waves.

In another ink drop discharging method, an electric-thermal transducer is provided to each ink chamber corresponding to an orifice. The ink is heated and vaporized into bubbles by the electric-thermal transducer so as to generate acoustic waves, and ink drops are discharged by acoustic energy of the acoustic waves.

In printers employing such ink drop discharging methods, a printer head unit having a plurality of orifices for discharging ink drops is mounted on a carrier with an ink cartridge. The carrier which is driven by a motor moves above the object such as paper in scanning movement. Along with the scanning movement of the carrier, ink drops are discharged from the orifices according to timing based on image data, and thereby an image according to the image data is generated on the object by the applied ink dots.

Some measures have been taken to realize high speed printing. The number of orifices has been increased so as to increase the number of simultaneously printed ink dots, and the ink discharge frequency (printing frequency) of each orifice (i.e. the driving frequency of the printer head) has been raised by optimizing the total configuration of the ink channel from the ink cartridge to the edge of the orifice.

The ink used for the ink jet printer is roughly divided into water-base ink and non-water-base ink. The water-base ink has the following advantages:

(1) The tolerances of physical properties (surface tension, viscosity, etc.) of the ink are wide and thus the stability of ink drop discharge properties can be made high.

(2) The main solvent is water and thus the change of physical properties due to volatilization does not occur much.

(3) Safe, stable, and easily handled.

(4) Good color development on paper.

On the other hand, the non-water-base ink has the following advantages:

(1) The materials for the printed object can be selected widely (iron, ceramic, etc.).

(2) Superior fixation on the printed object, little blur of ink.

(3) High water-resistance of prints.

The water-base ink is mainly used today for general and personal use, from the viewpoint of print quality, reliability of the printer head, etc.

In the water-base ink, coloring agents (dyes, pigments, etc.) and a variety of agents such as ink property control agents (surface-active agents, pH control agents, high-boiling-point agents) are mixed together. The agents are mixed together in a proper mixture ratio, in consideration of synergistic effects of the agents, physical properties of the ink, structure design of the printer head, etc.

The solubility in the main solvent varies depending on dyes, that is, depending on the color of ink, and thus agents such as die-solubility accelerator becomes necessary for some colors. Therefore, the type and the amount of additives vary depending on ink colors and thus the properties and stability of ink are necessitated to vary depending on colors. In order to raise the color density on the object and obtain vivid print, the amount of the coloring agent in ink has been increased.

The ink in the orifice of the ink jet printer head has a meniscus, that is, the interface of the ink to air. The meniscus has a concave curve which is caused by surface tension of the ink and a negative pressure of the ink cartridge. Evaporation of volatile ingredients of the ink easily occurs around the meniscus and thereby the properties of the ink tend to change around the meniscus. Especially, the viscosity of the ink tends to increase near the meniscus.

Due to the change of ink properties, the statuses of discharged ink drops are easily deteriorated when the ink is discharged after a long pause. Especially, change in the size of an ink drop, decrease of ink drop speed, variations in flying direction of ink drops, etc. occur, and thereby the quality of print is necessitated to be deteriorated. If the statuses of the ink around the meniscus gets worse, the orifice is stopped up with ink and ink discharge becomes difficult or impossible, causing fatal flaws in the printed output.

Some printer head maintenance methods have been proposed for avoiding the change of ink properties in the orifices (especially, the ink coagulation due to evaporation of volatile ingredients). In the following, a few conventional techniques for avoiding the ink coagulation due to change of ink properties will be explained.

In a conventional "ink jet printing method" disclosed in Japanese Patent Application Laid-Open No.SHO57-61576, each piezoelectric element which is used for discharging ink drops is driven also in pause periods with a voltage that is lower than a threshold voltage necessary for discharging the ink drops. In the conventional technique, an electric-mechanic transducer (i.e. the piezoelectric element) which is used for discharging ink drops is driven by the lower voltage (by which ink drops are not discharged) so as to give subtle vibration to the meniscus, and thereby the ink coagulation is prevented.

A conventional ink jet printing device is provided with an energy increase means which increases initial ink discharge energy in the case where ink drop discharge is restarted after a discharge pause period that is longer than a predetermined period. In the conventional technique, the ink discharge energy when the ink drop discharge is restarted is increased so that the properties of discharged ink drops such as speed, size, etc. will be close to those in continuous ink drop discharge operation.

The above conventional techniques could be employed for discharging ink drops stably in the case where the size of an ink drop is larger than the size of the orifice, since the ink drop discharge properties could have enough margins, that is, since a little environmental change did not exert effects on the ink drop discharge properties. However, the conventional techniques can not be employed for discharging ink drops stably and uniformly in the case where ink drops smaller than the diameter of the orifice are discharged by means of meniscus position control and acoustic wave control. In such cases, if the pause continues longer than a certain period, the ink drop discharge properties deteriorate considerably (decrease in speed and size of the ink drop, unstable flying statuses of the ink drops, etc.) causing shift of ink dot positions, uneven diameter of ink dots, dispersed ink dots due to unstable satellite ink drops, etc., and thereby the quality of printed image is deteriorated. In the meniscus position control and the acoustic wave control which are employed for discharging minute ink drops, precise control of ink properties is required for executing the meniscus position control and the acoustic wave control properly and thereby discharge minute ink drops correctly.

Even in the case of the water-base ink whose main solvent is water, the water-base ink used for ink jet printers shows slight thixotropic behavior. When a pause of the ink drop discharge (even a short pause in the scanning movement of the printer head between ink refresh operations) existed, ink flow in the ink channel changes and the thixotropic behavior of the ink in the meniscus position control emerges in a level that can not be neglected. The conventional techniques have not considered such thixotropic ink properties and thus could not realize stable discharge of minute ink drops. As the cause of the change of the ink flow in the ink channel, two states of the ink can be considered: a first state in the continuous ink drop discharge operation in which ink is constantly supplied from the ink pool to the orifice through the ink supply hole and the ink chamber, and a second state in the pause periods in which the ink drop discharge and the ink supply is stopped and thereby the ink flow becomes 0.

Further, in a plurality of to-and-fro action of the printer head, the viscosity of the ink around the meniscus raises locally due to evaporation of the volatile ingredients, thereby the energy applied for the meniscus position control and the acoustic wave control is dissipated, and thereby variations occur in the behavior of the meniscus and the formation of the ink column (an initial state of the ink drop including ink tail before being separated from the meniscus). In the continuous ink drop discharge operation in which ink discharge and ink refill are executed continuously, ink around the meniscuses is constantly replaced by ink supplied from the ink pool through the ink supply hole and the ink chamber. On the other hand, the ink replacement is not executed in the pause periods, thereby the local increase of the ink viscosity around the meniscus is caused.

Furthermore, when the ink jet printer is required to execute gradation printing, more precise ink drop control for generating minuter and uniform ink drops is required of the ink jet printer head. Therefore, it becomes more difficult to realize stable ink drop discharge for gradation printing by the conventional techniques.

The first conventional technique can hardly be applied to the case where minute ink drops are discharged by means of the meniscus position control and the acoustic wave control, since the vibration, which is given to the meniscuses or the ink chambers by the voltage lower than the threshold voltage necessary for ink drop discharging, is not enough for avoiding the deterioration of the ink drop property after pause periods. Little effect can be obtained even if the voltage is changed below the threshold voltage with a fast changing rate so as to give rapid change of the volume and pressure to the ink chamber, and thus ink drop discharge properties of desired precision can not be attained. In the case where the minute ink drop smaller than the diameter of the orifice is discharged by means of the meniscus position control and the acoustic wave control, the displacement of the piezoelectric element necessary for discharging ink drops is extremely small, therefore, only little displacement of ink can be attained by the voltage lower than the threshold voltage necessary for discharging ink drops, and thus the ink properties can not be maintained properly to be able to realize ink drop discharge properties equivalent to those in the continuous ink drop discharge operation. Therefore, stable minute ink drop discharge after pauses can not be attained by the subtle vibration. According to studies by the present inventors, large and a little slow displacement of ink is more effective than the rapid and subtle vibration, for the restart of the minute ink drop discharge.

Further, by the subtle vibration which is continuously given to the ink chamber and the meniscus in the pause periods with the driving frequency of the printer head, the number of (additional) actions of the piezoelectric element is increased much, and thereby the operating life of the printer head including the piezoelectric elements is necessitated to be short. When voltage is applied to the piezoelectric element, strain occurs in a piezoelectric material which is filled between electrodes of the layered piezoelectric element. In the case of the layered piezoelectric element, inactive parts, in which the internal electrodes are not paired (positive electrodes only or negative electrodes only), necessarily exist in the piezoelectric element on account of wiring. The inactive part does not exhibit piezoelectric effect, and thus large internal stress occurs at the interface between the active part and the inactive part. The continuous subtle vibration causing internal stress shortens the operating life of the piezoelectric element. Further, there is a possibility that the vibration of the piezoelectric element causes damage (splitting or peeling of the plate layers, etc.) to the layered head, shortening the operating life of the printer head. Also in the case of a bimorph element, stress caused by bending of the inactive plate and the piezoelectric plate decreases the life of the bimorph element.

A conventional "ink jet printing device" disclosed in Japanese Patent Application Laid-Open No.HEI9-30007 starts applying low voltage pulses (that are lower than a threshold voltage necessary for the ink drop discharge) to the piezoelectric element when a driving cycle of the printer head passed after the last ink drop discharge, so as to give the minute vibration to the ink meniscus, and stops the application of the low voltage pulses when a predetermined period passed. In the conventional technique, the application of the minute meniscus vibration is stopped after a predetermined period in order to avoid coagulation of ink due to evaporation of ink solvent. The continuous meniscus vibration promotes evaporation of ink solvent, causing coagulation of ink and stop-up of the orifices. The conventional technique avoids the stop-up of the orifices with ink by limiting the meniscus vibration period. Due to the limitation of the meniscus vibration period, the aforementioned problem with respect to the operating life of the ink jet printer head is also avoided. However, after the stop of the meniscus vibration, the ink drop properties keep on being deteriorated and no countermeasures are taken. Further, the minute meniscus vibration is not so effective for maintaining the ink properties in the discharge pause periods as a large and a little slow ink displacement, as mentioned above.

SUMMARY OF THE INVENTION

It is therefore the primary object of the present invention to provide a driving device and a driving method of an on-demand ink jet printer head which discharges minute ink drops by means of the meniscus position control and the acoustic wave control, by which uniform and stable ink drop discharge properties can be realized when ink drop discharge is restarted after a discharge pause period during scanning movement of the ink jet printer head, and thereby high quality printed output can be obtained with high stability.

Another object of the present invention is to provide a driving device and a driving method of an on-demand ink jet printer head, by which uniform and stable ink drop discharge can be realized without shortening the operating life of the electric-mechanic transducer for generating the acoustic wave and the operating life of the head layered body, along with reducing power consumption of the ink jet printer.

In accordance with a first aspect of the present invention, there is provided a driving device of an on-demand ink jet printer head for driving a printer head of an on-demand ink jet printer according to image data and thereby letting the ink jet printer head discharge ink drops from its orifices so that printing according to the image data will be executed. The driving device comprises a discharge voltage waveform application means, a discharge pause period length determination means, a pre-discharge voltage waveform determination means and a pre-discharge voltage waveform application means. The discharge voltage waveform application means generates discharge voltage waveforms corresponding to each orifice of the ink jet printer head based on the image data, and applies the discharge voltage waveforms to electric-mechanical transducers corresponding to each orifice so that ink drop discharge will be executed according to the image data due to volume change of each ink chamber corresponding to each orifice caused by movement of the electric-mechanical transducer and thereby an image according to the image data will be printed. The discharge pause period length determination means determines the length of each discharge pause period with respect to each orifice based on the image data. The pre-discharge voltage waveform determination means determines or selects a pre-discharge voltage waveform to be applied to the electric-mechanical transducer before restart of ink drop discharge after the discharge pause period, based on the length of the discharge pause period which has been determined by the discharge pause period length determination means. The pre-discharge voltage waveform application means applies the pre-discharge voltage waveform which has been determined by the pre-discharge voltage waveform determination means to the electric-mechanical transducer.

In accordance with a second aspect of the present invention, in the first aspect, the pre-discharge voltage waveform determination means sets voltage difference in the pre-discharge voltage waveform larger than voltage difference in the discharge voltage waveform.

In accordance with a third aspect of the present invention, in the first aspect, the pre-discharge voltage waveform determination means calculates a discharge pause cycle number by dividing the length of the discharge pause period by the driving cycle of the ink jet printer head, and determines or selects the pre-discharge voltage waveform based on the calculated discharge pause cycle number.

In accordance with a fourth aspect of the present invention, in the first aspect, the pre-discharge voltage waveform is applied to the electric-mechanical transducer just before the restart of the application of the discharge voltage waveform after the discharge pause period.

In accordance with a fifth aspect of the present invention, in the fourth aspect, the pre-discharge voltage waveform is applied to the electric-mechanical transducer a printer head driving cycle before the restart of the application of the discharge voltage waveform.

In accordance with a sixth aspect of the present invention, in the fourth aspect, the pre-discharge voltage waveform is applied to the electric-mechanical transducer two printer head driving cycles before the restart of the application of the discharge voltage waveform.

In accordance with a seventh aspect of the present invention, in the first aspect, the pre-discharge voltage waveform determination means executes the determination or selection of the pre-discharge voltage waveform so that ink meniscus vibration due to the application of the pre-discharge voltage waveform will be attenuated enough before the restart of the application of the discharge voltage waveform.

In accordance with an eighth aspect of the present invention, in the first aspect, the voltage of the pre-discharge voltage waveform is gradually increased from the bias voltage of the electric-mechanical transducer during the discharge pause period so as to decrease the volume of the ink chamber gradually and thereafter returned to the bias voltage just before the restart of the application of the discharge voltage waveform.

In accordance with a ninth aspect of the present invention, in the first aspect, the voltage of the pre-discharge voltage waveform is gradually decreased from the bias voltage of the electric-mechanical transducer during the discharge pause period so as to increase the volume of the ink chamber gradually and thereafter returned to the bias voltage just before the restart of the application of the discharge voltage waveform.

In accordance with a tenth aspect of the present invention, in the ninth aspect, the pre-discharge voltage waveform in the return to the bias voltage is set so that ink drop discharge will not be caused by decrease of the volume of the ink chamber.

In accordance with an eleventh aspect of the present invention, in the first aspect, the voltage of the pre-discharge voltage waveform is decreased below the bias voltage of the electric-mechanical transducer so as to increase the volume of the ink chamber and thereafter returned to the bias voltage just before the restart of the application of the discharge voltage waveform.

In accordance with a twelfth aspect of the present invention, in the eleventh aspect, voltage difference in the pre-discharge voltage waveform is set based on the length of the discharge pause period.

In accordance with a thirteenth aspect of the present invention, in the first aspect, the voltage of the pre-discharge voltage waveform is increased above the bias voltage of the electric-mechanical transducer so as to decrease the volume of the ink chamber and thereafter returned to the bias voltage just before the restart of the application of the discharge voltage waveform.

In accordance with a fourteenth aspect of the present invention, in the thirteenth aspect, voltage difference in the pre-discharge voltage waveform is set based on the length of the discharge pause period.

In accordance with a fifteenth aspect of the present invention, in the first aspect, the voltage of the pre-discharge voltage waveform is first decreased below the bias voltage of the electric-mechanical transducer so as to increase the volume of the ink chamber and thereafter increased above the bias voltage.

In accordance with a sixteenth aspect of the present invention, in the first aspect, the voltage of the pre-discharge voltage waveform is first increased above the bias voltage of the electric-mechanical transducer so as to decrease the volume of the ink chamber and thereafter decreased below the bias voltage.

In accordance with a seventeenth aspect of the present invention, in the first aspect, the voltage of the pre-discharge voltage waveform is decreased below the bias voltage of the electric-mechanical transducer so as to increase the volume of the ink chamber and returned to the bias voltage for N times just before the restart of the application of the discharge voltage waveform. The number N is determined by the pre-discharge voltage waveform determination means depending on the length of the discharge pause period.

In accordance with an eighteenth aspect of the present invention, in the first aspect, the voltage of the pre-discharge voltage waveform is increased above the bias voltage of the electric-mechanical transducer so as to decrease the volume of the ink chamber and returned to the bias voltage for N times just before the restart of the application of the discharge voltage waveform. The number N is determined by the pre-discharge voltage waveform determination means depending on the length of the discharge pause period.

In accordance with a nineteenth aspect of the present invention, there is provided a driving method of an on-demand ink jet printer head for driving a printer head of an on-demand ink jet printer according to image data and thereby letting the ink jet printer head discharge ink drops from its orifices so that printing according to the image data will be executed. The driving method comprises a discharge voltage waveform application step, a discharge pause period length determination step, a pre-discharge voltage waveform determination step and a pre-discharge voltage waveform application step. In the discharge voltage waveform application step, discharge voltage waveforms are generated corresponding to each orifice of the ink jet printer head based on the image data, and the discharge voltage waveforms are applied to electric-mechanical transducers corresponding to each orifice so that ink drop discharge will be executed according to the image data due to volume change of ink chambers corresponding to each orifice caused by movement of the electric-mechanical transducer and thereby an image according to the image data will be printed. In the discharge pause period length determination step, the length of each discharge pause period with respect to each orifice is determined based on the image data. In the pre-discharge voltage waveform determination step, a pre-discharge voltage waveform to be applied to the electric-mechanical transducer before restart of ink drop discharge after the discharge pause period is determined or selected based on the length of the discharge pause period which has been determined in the discharge pause period length determination step. In the pre-discharge voltage waveform application step, the pre-discharge voltage waveform which has been determined in the pre-discharge voltage waveform determination step is applied to the electric-mechanical transducer.

In accordance with a twentieth aspect of the present invention in the pre-discharge voltage waveform determination step of the nineteenth aspect, voltage difference in the pre-discharge voltage waveform is set larger than voltage difference in the discharge voltage waveform.

In accordance with a twenty-first aspect of the present invention, in the pre-discharge voltage waveform determination step of the nineteenth aspect, a discharge pause cycle number is calculated by dividing the length of the discharge pause period by the driving cycle of the ink jet printer head, and the pre-discharge voltage waveform is determined or selected based on the calculated discharge pause cycle number.

In accordance with a twenty-second aspect of the present invention, in the nineteenth aspect, the pre-discharge voltage waveform is applied to the electric-mechanical transducer just before the restart of the application of the discharge voltage waveform after the discharge pause period.

In accordance with a twenty-third aspect of the present invention, in the twenty-second aspect, the pre-discharge voltage waveform is applied to the electric-mechanical transducer a printer head driving cycle before the restart of the application of the discharge voltage waveform.

In accordance with a twenty-fourth aspect of the present invention, in the twenty-second aspect, the pre-discharge voltage waveform is applied to the electric-mechanical transducer two printer head driving cycles before the restart of the application of the discharge voltage waveform.

In accordance with a twenty-fifth aspect of the present invention, in the pre-discharge voltage waveform determination step of the nineteenth aspect, the determination or selection of the pre-discharge voltage waveform is executed so that ink meniscus vibration due to the application of the pre-discharge voltage waveform will be attenuated enough before the restart of the application of the discharge voltage waveform.

In accordance with a twenty-sixth aspect of the present invention, in the nineteenth aspect, the voltage of the pre-discharge voltage waveform is gradually increased from the bias voltage of the electric-mechanical transducer during the discharge pause period so as to decrease the volume of the ink chamber gradually and thereafter returned to the bias voltage just before the restart of the application of the discharge voltage waveform.

In accordance with a twenty-seventh aspect of the present invention, in the nineteenth aspect, the voltage of the pre-discharge voltage waveform is gradually decreased from the bias voltage of the electric-mechanical transducer during the discharge pause period so as to increase the volume of the ink chamber gradually and thereafter returned to the bias voltage just before the restart of the application of the discharge voltage waveform.

In accordance with a twenty-eighth aspect of the present invention, in the twenty-seventh aspect, the pre-discharge voltage waveform in the return to the bias voltage is set so that ink drop discharge will not be caused by decrease of the volume of the ink chamber.

In accordance with a twenty-ninth aspect of the present invention, in the nineteenth aspect, the voltage of the pre-discharge voltage waveform is decreased below the bias voltage of the electric-mechanical transducer so as to increase the volume of the ink chamber and thereafter returned to the bias voltage just before the restart of the application of the discharge voltage waveform.

In accordance with a thirtieth aspect of the present invention, in the twenty-ninth aspect, voltage difference in the pre-discharge voltage waveform is set based on the length of the discharge pause period.

In accordance with a thirty-first aspect of the present invention, in the nineteenth aspect, the voltage of the pre-discharge voltage waveform is increased above the bias voltage of the electric-mechanical transducer so as to decrease the volume of the ink chamber and thereafter returned to the bias voltage just before the restart of the application of the discharge voltage waveform.

In accordance with a thirty-second aspect of the present invention, in the thirty-first aspect, voltage difference in the pre-discharge voltage waveform is set based on the length of the discharge pause period.

In accordance with a thirty-third aspect of the present invention, in the nineteenth aspect, the voltage of the pre-discharge voltage waveform is first decreased below the bias voltage of the electric-mechanical transducer so as to increase the volume of the ink chamber and thereafter increased above the bias voltage.

In accordance with a thirty-fourth aspect of the present invention, in the nineteenth aspect, the voltage of the pre-discharge voltage waveform is first increased above the bias voltage of the electric-mechanical transducer so as to decrease the volume of the ink chamber and thereafter decreased below the bias voltage.

In accordance with a thirty-fifth aspect of the present invention, in the nineteenth aspect, the voltage of the pre-discharge voltage waveform is decreased below the bias voltage of the electric-mechanical transducer so as to increase the volume of the ink chamber and returned to the bias voltage for N times just before the restart of the application of the discharge voltage waveform. The number N is determined in the pre-discharge voltage waveform determination step depending on the length of the discharge pause period.

In accordance with a thirty-sixth aspect of the present invention, in the nineteenth aspect, the voltage of the pre-discharge voltage waveform is increased above the bias voltage of the electric-mechanical transducer so as to decrease the volume of the ink chamber and returned to the bias voltage for N times just before the restart of the application of the discharge voltage waveform. The number N is determined in the pre-discharge voltage waveform determination step depending on the length of the discharge pause period.

In accordance with thirty-seventh through fifty-fourth aspects of the present invention, there are provided machine-readable record mediums storing programs for instructing a microprocessor unit, etc. to execute processes for driving a printer head of an on-demand ink jet printer according to the driving methods of the nineteenth through thirty-sixth aspects of the present invention.

BRIEF DESCRIPTION OF THE DRAWINGS

The objects and features of the present invention will become more apparent from the consideration of the following detailed description taken in conjunction with the accompanying drawings, in which.

DESCRIPTION OF THE PREFERRED EMBODIMENTS

Figure 1:
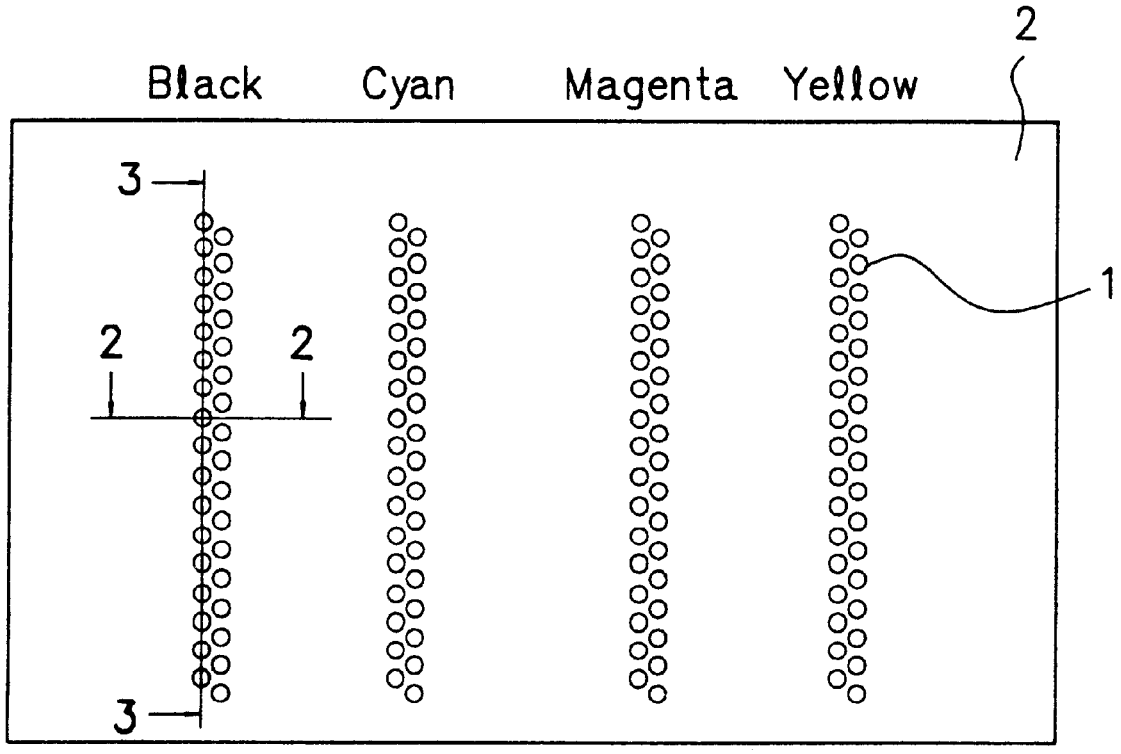
FIG. 1 is a plan view showing an example of an ink jet printer head which employs piezoelectric elements for discharging ink drops.

Referring now to the drawings, a description will be given in detail of preferred embodiments in accordance with the present invention.

Figure 2:
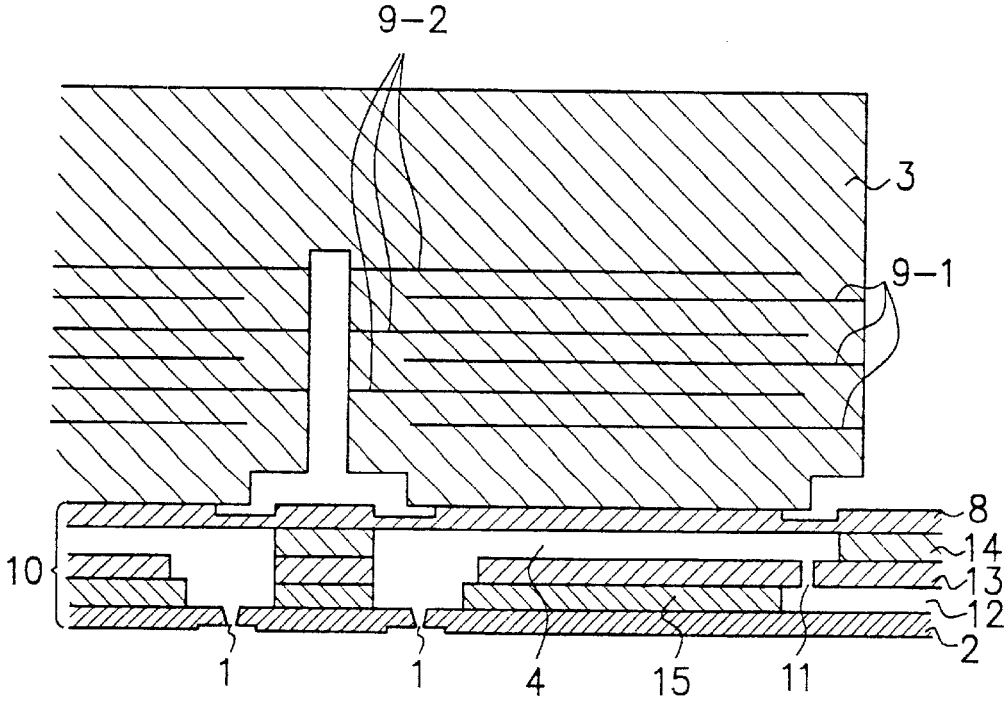
FIG. 2 is a cross sectional view of the ink jet printer head of FIG. 1 taken along the line A—A shown in FIG. 1.
Figure 3:
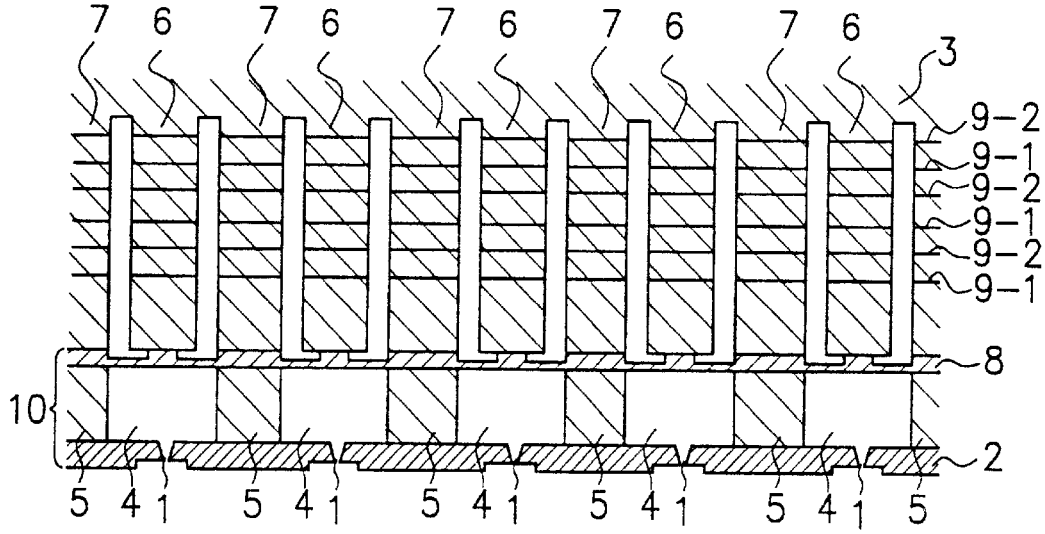
FIG. 3 is a cross sectional view of the ink jet printer head of FIG. 1 taken along the line B—B shown in FIG. 1.

FIG. 1 is a plan view showing an example of an ink jet printer head 20 which employs piezoelectric elements for discharging ink drops. FIG. 1 is a view seen from the side of an orifice plate 2 of the ink jet printer head 20. Referring to FIG. 1, orifices 1 for each color (black, cyan, magenta and yellow) are arranged in a predetermined pattern. FIG. 2 and FIG. 3 are cross sectional views of the ink jet printer head 20 of FIG. 1 taken along the line A—A and the line B—B shown in FIG. 1, respectively. Referring to FIGS. 2 and 3, the orifices 1 for discharging ink drops are formed through the orifice plate 2. An ink chamber 4 and an ink supply hole 11 are provided corresponding to each orifice 1. An ink channel is formed by the ink supply hole 11, the ink chamber 4 and the orifice 1.

A piezoelectric element 3 shown in FIG. 2 is a layered piezoelectric element, in which internal electrodes 9-1 and 9-2 of opposite polarity are stacked alternately so as to have gaps of 20 $\mu$m~50 $\mu$m which are filled with a piezoelectric material. The piezoelectric element 3 is divided into driving piezoelectric blocks 6 and support piezoelectric blocks 7. An originally formed piezoelectric element 3 is split into the driving piezoelectric blocks 6 and the support piezoelectric blocks 7 by forming slits which are deeper than the thickness of the layers of the internal electrodes 9-1 and 9-2 so that the driving piezoelectric blocks 6 can move independently from the support piezoelectric blocks 7. The splitting of the piezoelectric element 3 into the driving piezoelectric blocks 6 and the support piezoelectric blocks 7 is not done in the upper part of the piezoelectric element 3, and thus the driving piezoelectric blocks 6 and the support piezoelectric blocks 7 are connected together in the upper part. The bottoms of the driving piezoelectric blocks 6 and the support piezoelectric blocks 7 are bonded to a vibration plate 8. The drive piezoelectric block 6 is deformed by electrostriction of d33 mode, for example. The deformation of the drive piezoelectric block 6 vibrates the vibration plate 8 so as to rapidly change the volume and pressure in the ink chamber 4, and thereby generates energy for discharging ink drops. Voltage for causing the electrostriction is not applied to the support piezoelectric block 7. The support piezoelectric blocks 7 has effects of increasing the stiffness of a head layered body 10 (which is composed of the vibration plate 8, a chamber plate 14, a supply plate 13, a pool plate 15 and the orifice plate 2), decreasing pressure dissipation in the ink channel, reducing interference between adjacent ink chambers 4, etc.

The drive piezoelectric block 6 strains so as to decrease the volume of the ink chamber 4 when a potential difference (voltage difference) in the same direction as its polarization is applied, and strains so as to increase the volume of the ink chamber 4 when a potential difference of the reverse direction is applied. It is also possible to let the drive piezoelectric block 6 operate similarly to the case where the potential difference of the reverse direction is applied, by applying a potential difference of the polarization direction and thereafter decreasing the applied potential difference.

It is also possible to employ other types of piezoelectric elements 3 which exhibit electrostriction of other than d33 mode (d31 mode, d15 mode). Also in such cases, although the strain mode is different, the drive piezoelectric block 6 strains so as to decrease the volume of the ink chamber 4 when a potential difference of the polarization direction is applied, and strains so as to increase the volume of the ink chamber 4 when a potential difference of the reverse direction is applied, according to a similar principle.

Figure 4:
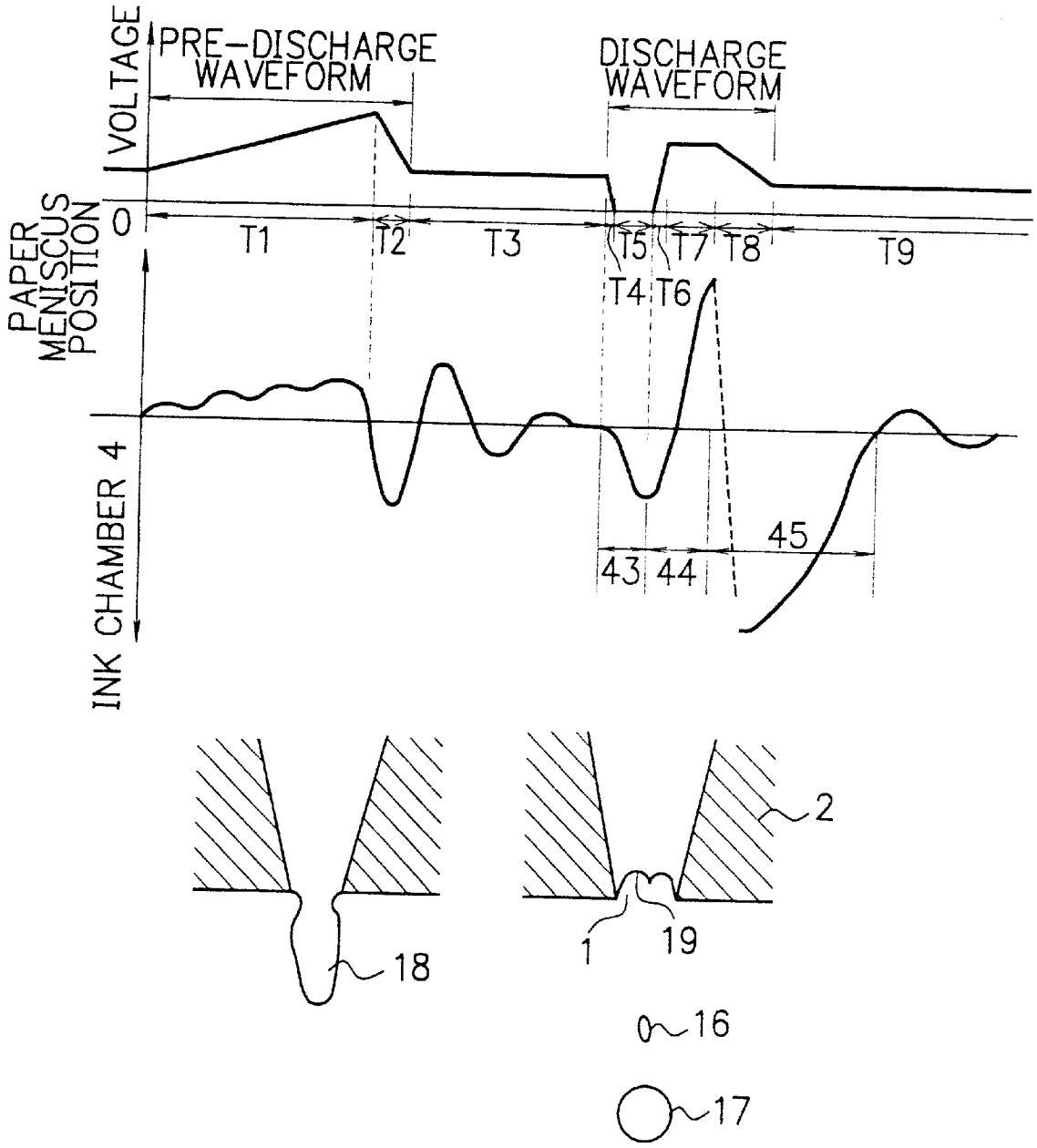
FIG. 4 is a graph showing an ink drop discharging process according to a first embodiment of the present invention, in which variations in applied voltage (variations in the volume of an ink chamber) and variations in the meniscus position are shown using the same time axis.

In the following, an ink drop discharging process of the ink jet printer head 20 for discharging an extremely minute ink drop by means of the meniscus position control and the acoustic wave control will be explained. FIG. 4 is a graph showing an ink drop discharging process according to the first embodiment of the present invention, in which variations in the applied voltage (variations in the volume of the ink chamber 4) and variations in the meniscus position are shown using the same time axis. At the bottom of FIG. 4, cross sections of the orifice 1 which is discharging an ink drop are also shown.

The meniscus in the initial state is assumed to have a concave curve having a recess of approximately 5 $\mu$m toward the ink chamber 4. The amount of recess is determined by the shape of the orifice 1, surface tension of the ink, negative pressure caused by the ink cartridge, etc. In this embodiment, the diameter of the orifice 1 is assumed to be 27 $\mu$m, the ink surface tension is assumed to be 33 dyne, and the negative pressure by the ink cartridge is assumed to be −40 mmH2O.

Referring to the "DISCHARGE WAVEFORM" shown in FIG. 4, the voltage applied to the drive piezoelectric block 6 is decreased to 0 V in the period T4 (2 $\mu$m), and the voltage is held at 0 V during the next period T5 (7 $\mu$m). The process of the periods T4 and T5 is the "meniscus position control". By the meniscus position control, the volume of the ink chamber 4 is increased and thereby the meniscus is recessed further toward the ink chamber 4 in comparison with the initial position.

In the next period T6 (1 $\mu$m), the voltage (0 V) which has been held in the period T5 is rapidly increased to 10 V, thereby the volume of the ink chamber 4 is quickly decreased and thereby discharge energy is applied to the ink. The increased voltage (10 V) is held during the next period T7 (3 $\mu$m). In the next period T8 (20 $\mu$m), the volume of the ink chamber 4 is increased and returned to an initial volume (the voltage is decreased to 6 V). By the increase of the volume of the ink chamber 4, an acoustic wave that is opposite to the acoustic wave due to the decrease of the volume of the ink chamber 4 is generated, and thereby separation of the ink column 18 from the orifice 1 is promoted. By the acoustic wave control (i.e. the periods T7 and T8), discharge of minute ink drops is realized. Thereafter, ink corresponding to the volume of the discharged ink drop is supplied from an ink pool 12 of the printer head 20 due to surface tension of the meniscus 19 and thereby the ink channel is refilled.

The above ink drop discharge operation can be roughly divided into three periods. The first period is a "meniscus position control period 43". In the meniscus position control period 43, the voltage is decreased to 0 V in the period T4 (2 $\mu$m) and held in the period T5 (7 $\mu$m), thereby the volume of the ink chamber 4 is set larger and thereby the meniscus is recessed toward the ink chamber 4 from the initial position.

The second period is an "ink drop discharge period 44". In the ink drop discharge period 44, the voltage is rapidly raised to 10 V in the period T6 (1 $\mu$m) and held in the period T7 (3 $\mu$m). By the rapid increase of the voltage, the volume of the ink chamber 4 is quickly decreased and thereby discharge energy is applied to the ink.

The third period is an "ink refill period 45". The ink refill period 45 starts with the period T8 (the latter part of the acoustic wave control). In the ink refill period 45, ink corresponding to the volume of the discharged ink drop is supplied from the ink pool 12 due to surface tension of the meniscus 19 and thereby the ink channel is refilled.

The ink drop discharge operation of the ink jet printer is implemented by repetition of the above three periods (the meniscus position control period 43, the ink drop discharge period 44 and the ink refill period 45) and thereby image according to the image data is printed on the object such as paper.

In the meniscus position control period 43, the meniscus 19 shown at the bottom of FIG. 4 is recessed toward the ink chamber 4, by decompressing the ink chamber 4 (by decreasing the voltage) before the application of the discharge energy to the ink. By the application of the discharge energy (by increase of the voltage which is applied to the drive piezoelectric block 6) when the ink is having the recessed meniscus 19, discharge of a minuter ink drop is realized in comparison with cases where the meniscus position control is not preliminarily executed. The size of a discharged ink drop becomes smaller as the recess is made larger. However, there is a limitation in the amount of recess depending on the shape of the orifice 1. The ink drop discharge properties become unstable if the recess is made too large. By adjusting the timing for applying the discharge energy based on a proper oscillation cycle which is intrinsic to the ink channel, the ink drop discharge can be executed with higher energy efficiency.

It is desirable for the minute ink drop discharge that the length of the high pressure holding period T7 after the application of the discharge energy (T6) is set within ½ of the proper (intrinsic) oscillation cycle of the ink channel. By such setting of the high pressure holding period T7, the decompression of the ink chamber 4 (T8) is executed before the acoustic energy generated in the discharge energy application period T6 is transmitted to the orifice 1, thereby splitting of a generated ink column 18 from the meniscus 19 (see the bottom of FIG. 4) is promoted and thereby formation of an extremely minute ink drop is realized.

The meniscus position control in the meniscus position control period 43 and the acoustic wave control in the ink drop discharge period 44 ought to be employed together, otherwise, the size of the minute ink drop can not be decreased to an extreme. By employing the meniscus position control and the acoustic wave control together, discharge of an ink drop of a diameter of 20 $\mu$m from the orifice 1 of a diameter of 27 $\mu$m becomes possible.

Figure 5:
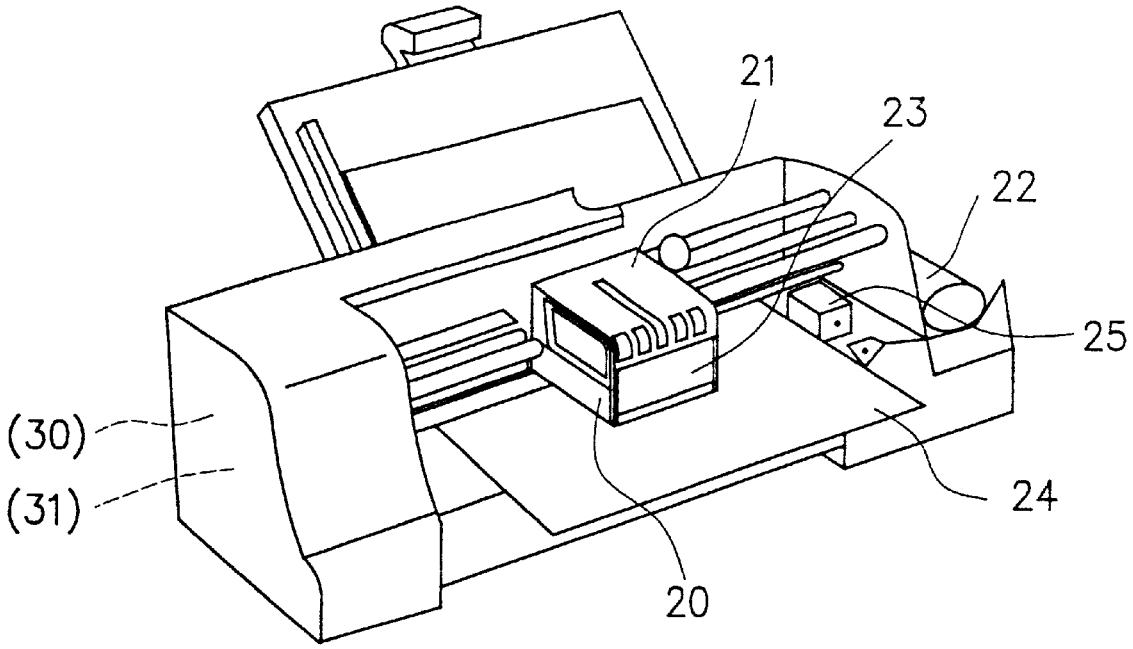
FIG. 5 is a perspective view of an ink jet printer.

FIG. 5 is a perspective view of an ink jet printer. Referring to FIG. 5, the printer head 20 which has been shown in FIG. 1 is mounted on a carrier 23 with an ink cartridge 21, and the carrier 23 which is driven by a motor 22 moves on paper 24 (the object) in scanning movement. In ink jet printers, "ink refresh operation" is generally executed after change (replacement) of the ink cartridge 21, after the ink jet printer is switched ON, after a predetermined number of scanning movements (to-and-fro movements) of the printer head 20, etc. In the ink jet printer of FIG. 5, the ink refresh operation is executed by a head maintenance section 25 on the right-hand side of the ink jet printer. In the ink refresh operation, part or all of ink in the ink channel is forcibly discharged by means of forcible ink suction by use of a roller pump, forcible ink discharge by application of the ink drop discharge voltage, etc. It is preferable that both the forcible ink suction by use of the roller pump and the forcible ink discharge by the application of the ink drop discharge voltage are executed after replacement of the ink cartridge 21 and after switch ON of the ink jet printer, and only the forcible ink discharge is executed during printing operation, for example, every 5 shuttle actions (to-and-fro movements) of the printer head 20, in consideration of printing speed, ink consumption, ink drop discharge properties, etc.

By one action (to or fro movement) of the printer head 20, an area of the paper 24 corresponding to the width of the orifices 1 arranged in vertical direction in FIG. 1 is printed. When the vertical resolution of the ink jet printer is finer than the dot pitch between the orifices 1, the printing of the above area is executed by two or more actions. If we assume the printing resolution of the ink jet printer is Nx [dpi], the driving frequency of the printer head 20 is Hf [Hz] and the horizontal length of the printed area is Lx [inch], scanning time of the printer head 20 for one action becomes (Nx× Lx)/Hf [sec]. For example, when a printer head 20 of a driving frequency of 10 kHz is used for executing printing to paper of "A4" size with a printing resolution of 1200 dpi, it takes approximately 1 second for the printer head 20 to execute one action (to or fro movement). It takes approximately 2 seconds for the printer head 20 to execute two actions (one to-and-fro movement) and thereby return to the head maintenance section 25. Therefore, the ink refresh operation can not be executed at least during the 2 seconds of to-and-fro movement of the printer head 20. Actually, the time necessary for one to-and-fro movement becomes longer, for ensuring accelerating area for the motor 22, stopping and reversing action of the printer head 20, etc.

Figure 6:
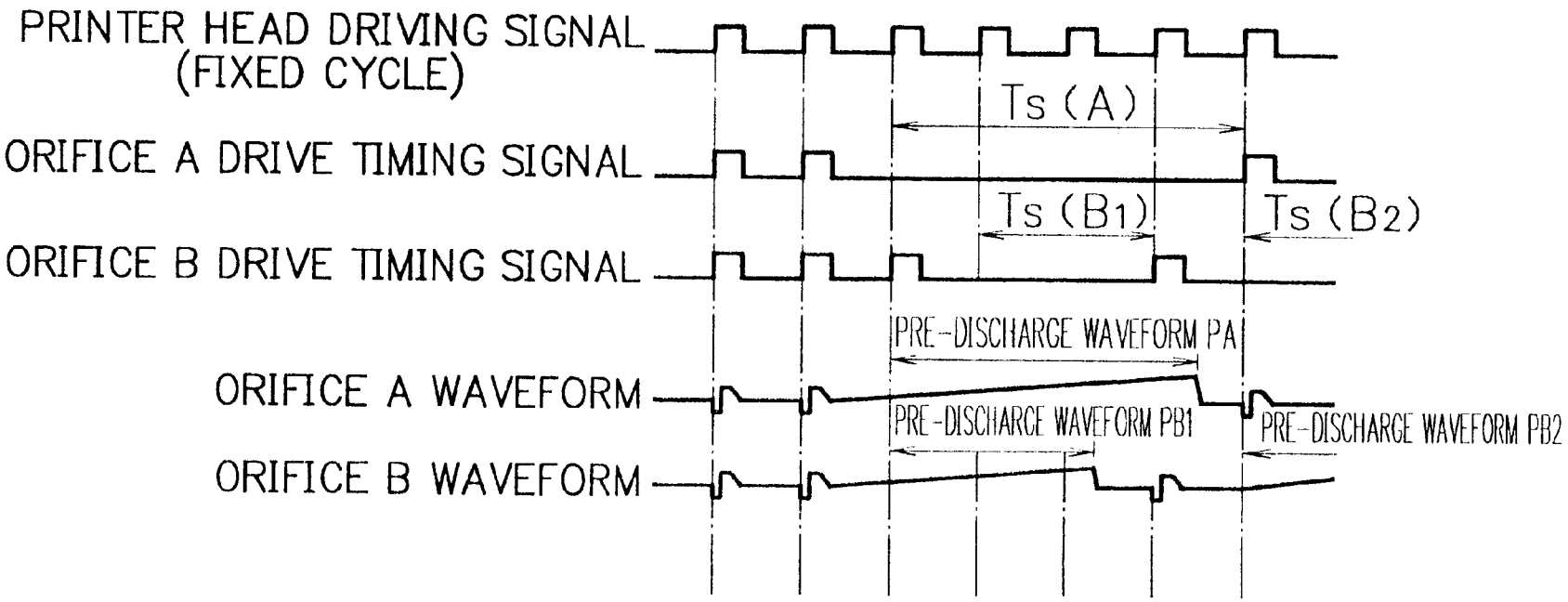
FIG. 6 is a graph showing an example of timing of signals for the ink jet printer head according to the present invention.

During the scanning movement of the printer head 20 on the paper 24, an unshown controller 30 of the ink jet printer outputs drive timing signals with respect to each of the orifices 1, as shown in FIG. 6. The drive timing signals for the orifices 1 are generated by the controller 30 based on image data which is supplied to the controller 30. Incidentally, the controller 30 is implemented by, for example, a microprocessor unit which is composed of a CPU (Central Processing Unit), ROM (Read Only Memory), RAM (Random Access Memory), etc., and appropriate software. Such software for realizing processes of the controller 30 is stored in one or more record mediums such as ROM, RAM, etc. An unshown driving circuit 31 of the ink jet printer generates and outputs driving signals (ink drop discharge waveforms) which are in sync with the drive timing signals, and applies the driving signals to the drive piezoelectric block 6. The application of the driving signals (ink drop discharge waveforms) is executed by the driving circuit 31 to each drive piezoelectric block 6 corresponding to each orifice 1, thereby ink drop discharge from the orifices 1 is executed according to the image data, and image according to the image data is printed on the paper 24.

In the case where gradation printing is executed by the ink jet printer, the controller 30 also outputs a waveform selection signal for designating the size of an ink drop to be discharged from the orifice 1. The driving circuit 31 which received the waveform selection signal and a corresponding drive timing signal controls or selects the waveform of the driving signal (ink drop discharge waveform) based on the waveform selection signal, and supplies the driving signal of the controlled or selected waveform to the drive piezoelectric block 6.

When ordinary image data is printed, the drive timing signal includes many discharge pause periods Ts during which ink drop discharge is not executed. Referring to the example of FIG. 6, an "orifice A drive timing signal" for driving a drive piezoelectric block 6 corresponding to the orifice A and an "orifice B drive timing signal" for driving a drive piezoelectric block 6 corresponding to the orifice B are shown. The orifice A drive timing signal shown in FIG. 6 includes a discharge pause period Ts(A), and the orifice B drive timing signal shown in FIG. 6 includes discharge pause periods Ts(B1) and Ts(B2), according to the image data.

For the discharge pause period Ts(A) of the orifice A drive timing signal shown in FIG. 6, the controller 30 determines a pre-discharge waveform PA that should be applied to the drive piezoelectric block 6 in the discharge pause period Ts(A), based on the image data. The driving circuit 31 outputs the pre-discharge waveform PA which has been determined by the controller 30 to the drive piezoelectric block 6. Therefore, a voltage signal which is applied by the driving circuit 31 to the drive piezoelectric block 6 corresponding to the orifice A becomes as the "ORIFICE A WAVEFORM" which is shown in FIG. 6. The controller 30 and the driving circuit 31 executes the same operations for the discharge pause periods Ts(B1) and Ts(B2) of the orifice B drive timing signal shown in FIG. 6. Therefore, a voltage signal which is applied by the driving circuit 31 to the drive piezoelectric block 6 corresponding to the orifice B becomes as the "ORIFICE B WAVEFORM" which is shown in FIG. 6. The above operations of the controller 30 and the driving circuit 31 are executed with respect to all the orifices 1 of the printer head 20.

The controller 30 determines or selects the pre-discharge waveform PA for each discharge pause period Ts depending on the length of the discharge pause period Ts which is determined based on the image data. In this process, the controller 30 can take the driving cycle of the printer head 20 into account, that is, the controller 30 can calculate a discharge pause cycle number (the number of driving cycles included in the discharge pause period Ts) by dividing the length of the discharge pause period Ts by the driving cycle and determine or select the pre-discharge waveform PA depending on the discharge pause cycle number.

In the following, the operation of the ink jet printer including the ink jet printer head driving device according to the first embodiment of the present invention will be described referring to FIGS. 6 through 8.

Referring to FIG. 6, drive timing signals for each orifice 1 of the printer head 20 is generated and outputted by the controller 30 based on the image data. As shown in FIG. 6, each drive timing signal is generated based on a printer head driving signal having a fixed printer head driving cycle. For each orifice 1 having a discharge pause period Ts longer than one printer head driving cycle, the controller 30 determines the pre-discharge waveform so that the pre-discharge waveform will be applied to the drive piezoelectric block 6 corresponding to the orifice 1 and thereby the volume of the ink chamber 4 will be changed before the application of the discharge waveform to the drive piezoelectric block 6 is restarted after the discharge pause period Ts.

FIG. 4 shows measurement results of variations in the voltage which is applied to the drive piezoelectric block 6 (variations in the volume of the ink chamber 4) and variations in the meniscus position. A bias voltage of 6 V is applied to the piezoelectric element 3 (the drive piezoelectric blocks 6). If a discharge pause period Ts existed, the pre-discharge waveform corresponding to the discharge pause period Ts is determined and applied. In the period T1 (50 $\mu$m) shown in FIG. 4, the voltage applied to the drive piezoelectric block 6 is gradually increased up to 21 V (i.e. the volume of the ink chamber 4 is gradually decreased) and thereby the meniscus 19 is gradually moved in the direction toward the paper 24.

In the next period T2 (10 $\mu$m), the voltage applied to the drive piezoelectric block 6 is decreased (i.e. the volume of the ink chamber 4 is increased) more rapidly than the rate in the period T1, and thereby the meniscus 19 is a little rapidly moved to the direction toward the ink chamber 4. By the change of the volume of the ink chamber 4 in the periods T1 and T2, the meniscus 19 makes a large and a little slow to-and-fro movement and thereby the ink in the ink channel is moved and stirred. After vibration of the meniscus 19 which occurred in the period T2 attenuated enough, the discharge waveform is applied.

In the discharge waveform shown in FIG. 4, the meniscus 19 is recessed by decreasing the voltage below the bias voltage and holding the voltage (periods T4 and T5), and thereafter the ink drop discharge energy is applied (period T6). The raised voltage is held for 3 $\mu$m (period T7) and thereafter returned to the bias voltage (period T8), thereby discharge of the minute ink drop is executed. Ink corresponding to the volume of the discharged ink drop is supplied from the ink pool 12 and thereby the ink channel is refilled.

The volume control of the ink chamber 4 in the pre-discharge waveform is executed by voltage difference of 15V for example, while the volume control of the ink chamber 4 in the discharge waveform is executed by voltage difference of 10V for example. Especially in the case where the meniscus position control and the acoustic wave control are employed for discharging minute ink drops, it is preferable that the voltage difference in the period T2 of the pre-discharge waveform is set larger than the voltage difference in the period T6 of the discharge waveform.

Figure 7:
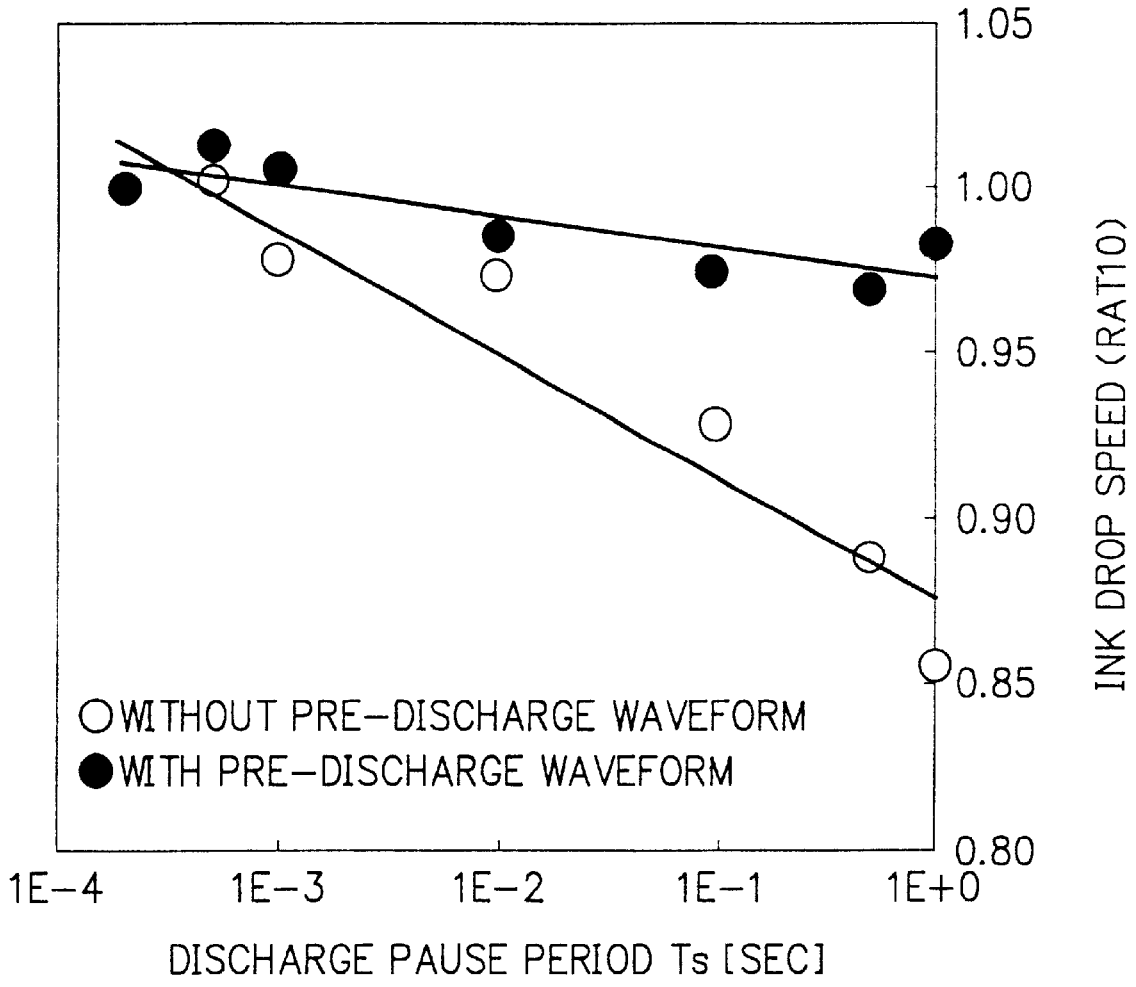
FIG. 7 is a graph depicting experimental data showing the effect of the pre-discharge waveform according to the present invention.

FIG. 7 is a graph depicting experimental data showing the effect of the pre-discharge waveform according to the present invention. In the experiment, ink drop speed on the restart of ink drop discharge was measured after a discharge pause period Ts after a continuous ink drop discharge operation. Data was collected with respect to various discharge pause periods Ts, and with respect to two cases: a case where the pre-discharge waveform is applied and a case where the pre-discharge waveform is not applied. In the case where the pre-discharge waveform was not applied, the ink drop speed decreased as the discharge pause period Ts became longer. On the other hand, in the case where the pre-discharge waveform was applied, the decrease of the ink drop speed was very small.

Figure 8:
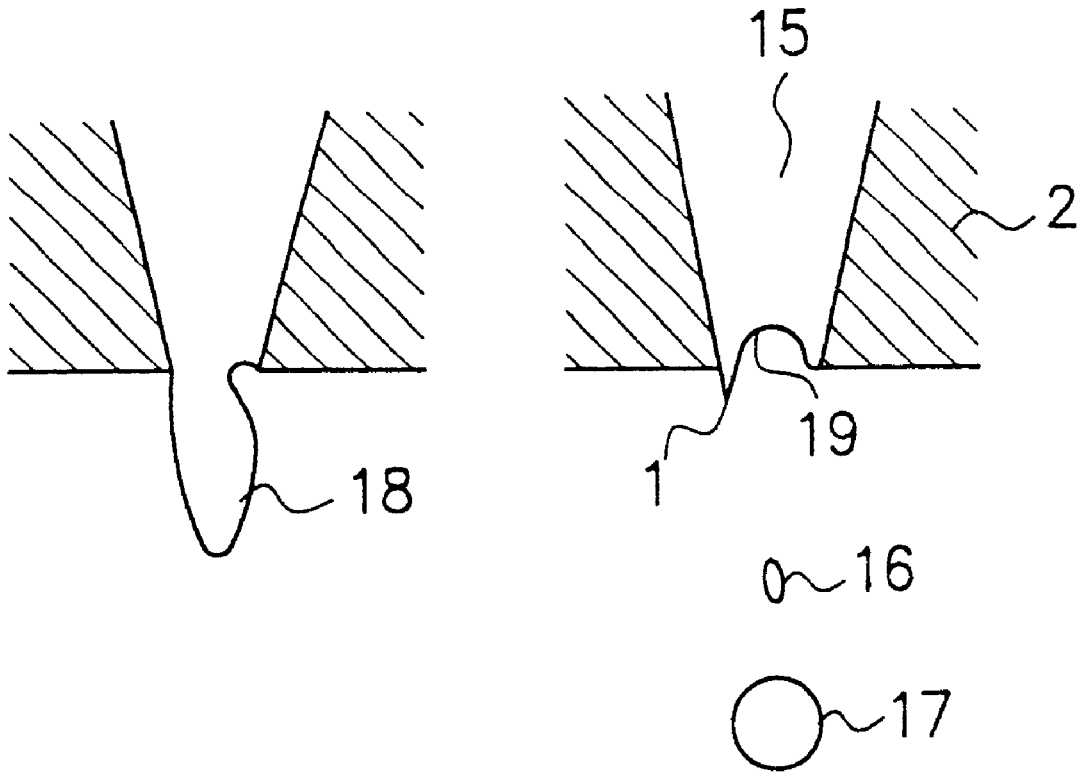
FIG. 8 is a schematic diagram showing a result of observation of a discharged ink drop in the case where the pre-discharge waveform was not applied.

FIG. 8 is a schematic diagram showing a result of observation of a discharged ink drop in the case where the pre-discharge waveform was not applied. As shown in FIG. 8, in the case where an ink drop is discharged when no ink flow exists at all or when the viscosity of ink around the meniscus 19 is locally increased, an ink column 18 which is initially formed by the discharged ink was attracted to part of the edge of the orifice 1, thereby the shape of a main ink drop 17 became unstable and the flying direction of a satellite ink drop 16 became irregular, exhibiting unstable ink drop discharge properties differently from the case of FIG. 4 where the pre-discharge waveform was applied. Incidentally, in the above experiments, the variations in the meniscus position (vibration) and the ink drop speed were observed and measured by means of a laser Doppler vibrometer, by taking photograph using electric flash, etc. The observation of the discharged ink drop was conducted using a high speed video camera.

Figure 9:
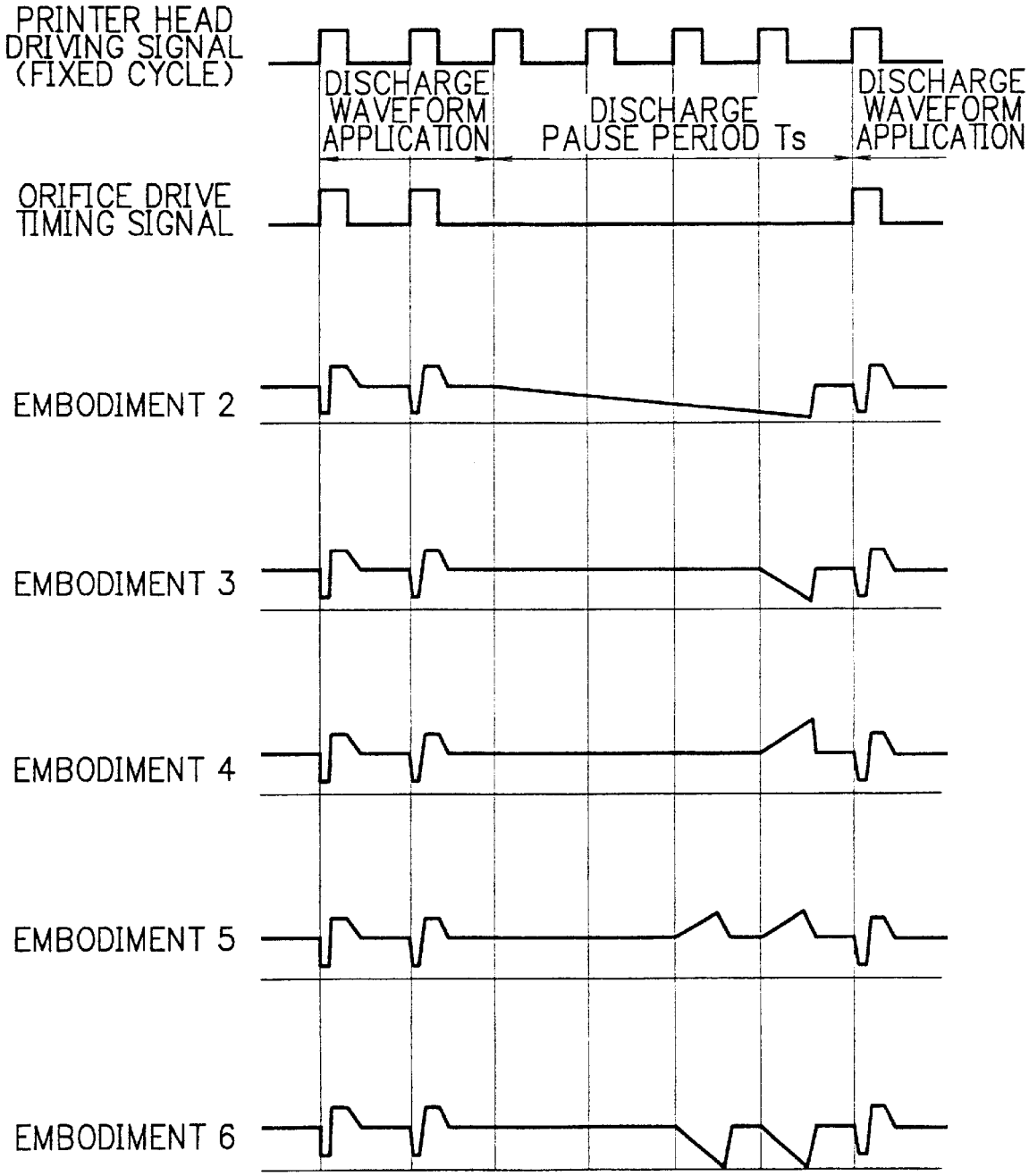
FIG. 9 is a graph showing pre-discharge waveforms which are employed in second through sixth embodiments of the present invention.

In the following, other embodiments according to the present invention will be explained. FIG. 9 is a graph showing pre-discharge waveforms which are employed in the second through sixth embodiments of the present invention.

In the second embodiment, the voltage applied to the drive piezoelectric block 6 is gradually decreased in the discharge pause period Ts so as to increase the volume of the ink chamber 4 gradually, and thereafter the voltage is increased just before the restart of the application of the discharge waveform so as to decrease the volume of the ink chamber 4. By the volume change caused by the pre-discharge waveform, ink in the ink chamber 4 is moved and stirred. In the increase of the voltage (decrease of the volume of the ink chamber 4) in the pre-discharge waveform, the changing rate of the voltage is set so as not to cause ink drop discharge.

In the third embodiment, the volume change of the ink chamber 4 is not executed as slowly as the second embodiment. A short pre-discharge waveform is applied a driving cycle before the restart of the application of the discharge waveform. The volume of the ink chamber 4 is first increased and thereafter decreased, and thereby the ink in the ink chamber 4 is moved and stirred. In this embodiment, the width of the pre-discharge waveform in time is fixed, and the voltage difference (depth) of the pre-discharge waveform is controlled by the controller 30 depending on the length of the discharge pause period Ts. Concretely, the voltage difference is set larger as the discharge pause period Ts becomes longer.

In the fourth embodiment, the volume of the ink chamber 4 is first decreased and thereafter increased. The timing for the pre-discharge waveform is the same as that of the third embodiment. Also in this embodiment, the voltage difference of the pre-discharge waveform is controlled by the controller 30 depending on the length of the discharge pause period Ts.

In the fifth and sixth embodiments, a short fixed pre-discharge waveform are repeated for N times before the restart of the application of the discharge waveform. The number N is determined by the controller 30 depending on the length of the discharge pause period Ts. Concretely, the number N is set larger for longer discharge pause period Ts. The fifth and sixth embodiments are preferably employed when the controller 30 or the driving circuit 31 can not handle a variety of waveforms because of circuit composition, cost, etc.

Although not shown in the embodiments of FIG. 9, it is also possible to first decrease the voltage of the pre-discharge waveform below the bias voltage and thereafter increase the voltage above the bias voltage, or first increase the voltage above the bias voltage and thereafter decrease the voltage below the bias voltage. By using such pre-discharge waveforms, a larger voltage difference can be obtained without putting a heavy load on the power supply of the ink jet printer, and thereby the volume change of the ink chamber 4 can be made larger.

While the voltage of the pre-discharge waveform (for applying the potential difference to the piezoelectric element 3 (drive piezoelectric block 6)) was controlled to be positive in the above embodiments, the voltage of the pre-discharge waveform can also be decreased below 0 V so as to apply potential difference of the reverse direction (potential difference in the direction opposite to the polarization of the piezoelectric element 3) as long as the polarization of the piezoelectric element 3 is not reversed. By use of such negative voltage, the volume of the ink chamber 4 can be increased more due to larger strain of the drive piezoelectric block 6, and thereby the movement of ink in the ink channel can be enhanced.

While some embodiments have been explained above, the pre-discharge waveform according to the present invention is not limited to the above embodiments. The pre-discharge waveform according to the present invention can be modified and designed arbitrarily as long as the length of the discharge pause period Ts with respect to each orifice 1 is taken into consideration.

As set forth hereinabove, by the driving device and the driving method of an on-demand ink jet printer head according to the present invention, in an on-demand ink jet printer head for discharging minute ink drops by means of the meniscus position control and the acoustic wave control, the length of each discharge pause period Ts with respect to each orifice 1 is determined (detected) based on the image data, and a pre-discharge waveform is determined for each discharge pause period Ts based on the length of the discharge pause period Ts. And the pre-discharge waveform is applied to the electric-mechanic transducer (drive piezoelectric block 6 etc.) before the restart of the application of the discharge waveform. Therefore, a large displacement which is designed depending on the length of the discharge pause period Ts can be given to the ink before the restart of the ink drop discharge so that the ink will be moved and stirred, thereby uniformity and stability of the ink drop discharge properties (size, speed, flying direction, etc.) can be realized at the restart of the ink drop discharge after the discharge pause period Ts, and thereby high quality ink jet printing can be executed stably.

The ink which is filled in the ink channel exhibits, although slightly, thixotropic behavior, therefore, the secondary bonding force (van der Waals force, etc.) which acts between adjacent molecules and particles gets larger in the discharge pause period Ts than in the continuous ink drop discharge operation. The difference of the secondary bonding force is caused by the difference of the status of the ink. Ink corresponding to the volume of a discharged ink drop is constantly supplied from the ink pool 12 and thereby the ink in the ink channel constantly flows in the continuous ink drop discharge operation, whereas no ink is supplied from the ink pool 12 and the ink in the ink channel does not flow at all in the discharge pause periods Ts. By the driving device and the driving method of an on-demand ink jet printer head according to the present invention, the volume of the ink chamber 4 is changed just before the restart of the ink drop discharge after each discharge pause period Ts, thereby the secondary bonding force at the restart can be set to the same level as that in the continuous ink drop discharge operation, thereby the ink drop discharge properties at the restart can be conditioned to the same levels as those in the continuous ink drop discharge operation. Further, even if the viscosity of the ink locally increased around the meniscus during the discharge pause period Ts due to evaporation of the ink solvent etc., the ink is moved and stirred by the large movement of the ink due to the pre-discharge waveform and the ink viscosity is decreased to the original level. Therefore, uniform and stable ink drop discharge properties can be realized.

In the conventional techniques employing the continuously repeated minute meniscus vibration by means of lower voltage signals, evaporation of the ink solvent tends to be promoted, thereby the concentration of the coloring agents (dyes, pigments) etc. and the ink viscosity tend to increase around the meniscus or in the ink chamber 4, and thereby the ink drop discharge properties are necessitated to be deteriorated. On the other hand, in the driving device and the driving method of an on-demand ink jet printer head according to the present invention, the increase of ink viscosity due to the continuous meniscus vibration is avoided.

Further, due to the avoidance of the continuous vibration of the piezoelectric element 3 for the continuous meniscus vibration, the stable and uniform ink drop discharge can be attained without shortening the operating life of the piezoelectric element 3 and with reducing power consumption of the ink jet printer.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A driving device of an on-demand ink jet printer head for driving a printer head of an on-demand ink jet printer according to image data and thereby letting the ink jet printer head discharge ink drops from its orifices so that printing according to the image data will be executed, comprising:

a discharge voltage waveform application means for generating discharge voltage waveforms corresponding to each orifice of the ink jet printer head based on the image data, and applying the discharge voltage waveforms to electric-mechanical transducers corresponding to each orifice so that ink drop discharge will be executed according to the image data due to volume change of each ink chamber corresponding to each orifice caused by movement of the electric-mechanical transducer and thereby an image according to the image data will be printed;

a discharge pause period length determination means for determining the length of each discharge pause period with respect to each orifice based on the image data;

a pre-discharge voltage waveform determination means for determining or selecting a pre-discharge voltage waveform to be applied to the electric-mechanical transducer before restart of ink drop discharge after the discharge pause period, based on the length of the discharge pause period which has been determined by the discharge pause period length determination means; and a pre-discharge voltage waveform application means for applying the pre-discharge voltage waveform which has been determined by the pre-discharge voltage waveform determination means to the electric-mechanical transducer.

2. A driving device of an on-demand ink jet printer head as claimed in claim 1, wherein the pre-discharge voltage waveform determination means sets voltage difference in the pre-discharge voltage waveform larger than voltage difference in the discharge voltage waveform.

3. A driving device of an on-demand ink jet printer head as claimed in claim 1, wherein the pre-discharge voltage waveform determination means calculates a discharge pause cycle number by dividing the length of the discharge pause period by the driving cycle of the ink jet printer head, and determines or selects the pre-discharge voltage waveform based on the calculated discharge pause cycle number.

4. A driving device of an on-demand ink jet printer head as claimed in claim 1, wherein the pre-discharge voltage waveform is applied to the electric-mechanical transducer just before the restart of the application of the discharge voltage waveform after the discharge pause period.

5. A driving device of an on-demand ink jet printer head as claimed in claim 4, wherein the pre-discharge voltage waveform is applied to the electric-mechanical transducer a printer head driving cycle before the restart of the application of the discharge voltage waveform.

6. A driving device of an on-demand ink jet printer head as claimed in claim 4, wherein the pre-discharge voltage waveform is applied to the electric-mechanical transducer two printer head driving cycles before the restart of the application of the discharge voltage waveform.

7. A driving device of an on-demand ink jet printer head as claimed in claim 1, wherein the pre-discharge voltage waveform determination means executes the determination or selection of the pre-discharge voltage waveform so that ink meniscus vibration due to the application of the pre-discharge voltage waveform will be attenuated enough before the restart of the application of the discharge voltage waveform.

8. A driving device of an on-demand ink jet printer head as claimed in claim 1, wherein in the pre-discharge voltage waveform, the voltage is gradually increased from the bias voltage of the electric-mechanical transducer during the discharge pause period so as to decrease the volume of the ink chamber gradually and thereafter returned to the bias voltage just before the restart of the application of the discharge voltage waveform.

9. A driving device of an on-demand ink jet printer head as claimed in claim 1, wherein in the pre-discharge voltage waveform, the voltage is gradually decreased from the bias voltage of the electric-mechanical transducer during the discharge pause period so as to increase the volume of the ink chamber gradually and thereafter returned to the bias voltage just before the restart of the application of the discharge voltage waveform.

10. A driving device of an on-demand ink jet printer head as claimed in claim 9, wherein the pre-discharge voltage waveform in the return to the bias voltage is set so that ink drop discharge will not be caused by decrease of the volume of the ink chamber.

11. A driving device of an on-demand ink jet printer head as claimed in claim 1, wherein in the pre-discharge voltage waveform, the voltage is decreased below the bias voltage of the electric-mechanical transducer so as to increase the volume of the ink chamber and thereafter returned to the bias voltage just before the restart of the application of the discharge voltage waveform.

12. A driving device of an on-demand ink jet printer head as claimed in claim 11, wherein voltage difference in the pre-discharge voltage waveform is set based on the length of the discharge pause period.

13. A driving device of an on-demand ink jet printer head as claimed in claim 1, wherein in the pre-discharge voltage waveform, the voltage is increased above the bias voltage of the electric-mechanical transducer so as to decrease the volume of the ink chamber and thereafter returned to the bias voltage just before the restart of the application of the discharge voltage waveform.

14. A driving device of an on-demand ink jet printer head as claimed in claim 13, wherein voltage difference in the pre-discharge voltage waveform is set based on the length of the discharge pause period.

15. A driving device of an on-demand ink jet printer head as claimed in claim 1, wherein in the pre-discharge voltage waveform, the voltage is first decreased below the bias voltage of the electric-mechanical transducer so as to increase the volume of the ink chamber and thereafter increased above the bias voltage.

16. A driving device of an on-demand ink jet printer head as claimed in claim 1, wherein in the pre-discharge voltage waveform, the voltage is first increased above the bias voltage of the electric-mechanical transducer so as to decrease the volume of the ink chamber and thereafter decreased below the bias voltage.

17. A driving device of an on-demand ink jet printer head as claimed in claim 1, wherein in the pre-discharge voltage waveform, the voltage is decreased below the bias voltage of the electric-mechanical transducer so as to increase the volume of the ink chamber and returned to the bias voltage for N times just before the restart of the application of the discharge voltage waveform, in which the number N is determined by the pre-discharge voltage waveform determination means depending on the length of the discharge pause period.

18. A driving device of an on-demand ink jet printer head as claimed in claim 1, wherein in the pre-discharge voltage waveform, the voltage is increased above the bias voltage of the electric-mechanical transducer so as to decrease the volume of the ink chamber and returned to the bias voltage for N times just before the restart of the application of the discharge voltage waveform, in which the number N is determined by the pre-discharge voltage waveform determination means depending on the length of the discharge pause period.

19. A driving method of an on-demand ink jet printer head for driving a printer head of an on-demand ink jet printer according to image data and thereby letting the ink jet printer head discharge ink drops from its orifices so that printing according to the image data will be executed, comprising the steps of:

a discharge voltage waveform application step in which discharge voltage waveforms are generated corresponding to each orifice of the ink jet printer head based on the image data, and the discharge voltage waveforms are applied to electric-mechanical transducers corresponding to each orifice so that ink drop discharge will be executed according to the image data due to volume change of each ink chamber corresponding to each orifice caused by movement of the electric-mechanical transducer and thereby an image according to the image data will be printed;

a discharge pause period length determination step in which the length of each discharge pause period with respect to each orifice is determined based on the image data;

a pre-discharge voltage waveform determination step in which a pre-discharge voltage waveform to be applied to the electric-mechanical transducer before restart of ink drop discharge after the discharge pause period is determined or selected based on the length of the discharge pause period which has been determined in the discharge pause period length determination step; and a pre-discharge voltage waveform application step in which the pre-discharge voltage waveform which has been determined in the pre-discharge voltage waveform determination step is applied to the electric-mechanical transducer.

20. A driving method of an on-demand ink jet printer head as claimed in claim 19, wherein in the pre-discharge voltage waveform determination step, voltage difference in the pre-discharge voltage waveform is set larger than voltage difference in the discharge voltage waveform.

21. A driving method of an on-demand ink jet printer head as claimed in claim 19, wherein in the pre-discharge voltage waveform determination step, a discharge pause cycle number is calculated by dividing the length of the discharge pause period by the driving cycle of the ink jet printer head, and the pre-discharge voltage waveform is determined or selected based on the calculated discharge pause cycle number.

22. A driving method of an on-demand ink jet printer head as claimed in claim 19, wherein the pre-discharge voltage waveform is applied to the electric-mechanical transducer just before the restart of the application of the discharge voltage waveform after the discharge pause period.

23. A driving method of an on-demand ink jet printer head as claimed in claim 22, wherein the pre-discharge voltage waveform is applied to the electric-mechanical transducer a printer head driving cycle before the restart of the application of the discharge voltage waveform.

24. A driving method of an on-demand ink jet printer head as claimed in claim 22, wherein the pre-discharge voltage waveform is applied to the electric-mechanical transducer two printer head driving cycles before the restart of the application of the discharge voltage waveform.

25. A driving method of an on-demand ink jet printer head as claimed in claim 19, wherein in the pre-discharge voltage waveform determination step, the determination or selection of the pre-discharge voltage waveform is executed so that ink meniscus vibration due to the application of the pre-discharge voltage waveform will be attenuated enough before the restart of the application of the discharge voltage waveform.

26. A driving method of an on-demand ink jet printer head as claimed in claim 19, wherein in the pre-discharge voltage waveform, the voltage is gradually increased from the bias voltage of the electric-mechanical transducer during the discharge pause period so as to decrease the volume of the ink chamber gradually and thereafter returned to the bias voltage just before the restart of the application of the discharge voltage waveform.

27. A driving method of an on-demand ink jet printer head as claimed in claim 19, wherein in the pre-discharge voltage waveform, the voltage is gradually decreased from the bias voltage of the electric-mechanical transducer during the discharge pause period so as to increase the volume of the ink chamber gradually and thereafter returned to the bias voltage just before the restart of the application of the discharge voltage waveform.

28. A driving method of an on-demand ink jet printer head as claimed in claim 27, wherein the pre-discharge voltage waveform in the return to the bias voltage is set so that ink drop discharge will not be caused by decrease of the volume of the ink chamber.

29. A driving method of an on-demand ink jet printer head as claimed in claim 19, wherein in the pre-discharge voltage waveform, the voltage is decreased below the bias voltage of the electric-mechanical transducer so as to increase the volume of the ink chamber and thereafter returned to the bias voltage just before the restart of the application of the discharge voltage waveform.

30. A driving method of an on-demand ink jet printer head as claimed in claim 29, wherein voltage difference in the pre-discharge voltage waveform is set based on the length of the discharge pause period.

31. A driving method of an on-demand ink jet printer head as claimed in claim 19, wherein in the pre-discharge voltage waveform, the voltage is increased above the bias voltage of the electric-mechanical transducer so as to decrease the volume of the ink chamber and thereafter returned to the bias voltage just before the restart of the application of the discharge voltage waveform.

32. A driving method of an on-demand ink jet printer head as claimed in claim 31, wherein voltage difference in the pre-discharge voltage waveform is set based on the length of the discharge pause period.

33. A driving method of an on-demand ink jet printer head as claimed in claim 19, wherein in the pre-discharge voltage waveform, the voltage is first decreased below the bias voltage of the electric-mechanical transducer so as to increase the volume of the ink chamber and thereafter increased above the bias voltage.

34. A driving method of an on-demand ink jet printer head as claimed in claim 19, wherein in the pre-discharge voltage waveform, the voltage is first increased above the bias voltage of the electric-mechanical transducer so as to decrease the volume of the ink chamber and thereafter decreased below the bias voltage.

35. A driving method of an on-demand ink jet printer head as claimed in claim 19, wherein in the pre-discharge voltage waveform, the voltage is decreased below the bias voltage of the electric-mechanical transducer so as to increase the volume of the ink chamber and returned to the bias voltage for N times just before the restart of the application of the discharge voltage waveform, in which the number N is determined in the pre-discharge voltage waveform determination step depending on the length of the discharge pause period.

36. A driving method of an on-demand ink jet printer head as claimed in claim 19, wherein in the pre-discharge voltage waveform, the voltage is increased above the bias voltage of the electric-mechanical transducer so as to decrease the volume of the ink chamber and returned to the bias voltage for N times just before the restart of the application of the discharge voltage waveform, in which the number N is determined in the pre-discharge voltage waveform determination step depending on the length of the discharge pause period.

37. A machine-readable record medium storing a program for instructing at least a microprocessor unit to execute processes for driving a printer head of an on-demand ink jet printer according to image data and thereby letting the ink jet printer head discharge ink drops from its orifices so that printing according to the image data will be executed, wherein the processes include:

a discharge voltage waveform application step in which discharge voltage waveforms are generated corresponding to each orifice of the ink jet printer head based on the image data, and the discharge voltage waveforms are applied to electric-mechanical transducers corresponding to each orifice so that ink drop discharge will be executed according to the image data due to volume change of each ink chamber corresponding to each orifice caused by movement of the electric-mechanical transducer and thereby an image according to the image data will be printed;

a discharge pause period length determination step in which the length of each discharge pause period with respect to each orifice is determined based on the image data;

a pre-discharge voltage waveform determination step in which a pre-discharge voltage waveform to be applied to the electric-mechanical transducer before restart of ink drop discharge after the discharge pause period is determined or selected based on the length of the discharge pause period which has been determined in the discharge pause period length determination step; and a pre-discharge voltage waveform application step in which the pre-discharge voltage waveform which has been determined in the pre-discharge voltage waveform determination step is applied to the electric-mechanical transducer.

38. A machine-readable record medium as claimed in claim 37, wherein in the pre-discharge voltage waveform determination step, voltage difference in the pre-discharge voltage waveform is set larger than voltage difference in the discharge voltage waveform.

39. A machine-readable record medium as claimed in claim 37, wherein in the pre-discharge voltage waveform determination step, a discharge pause cycle number is calculated by dividing the length of the discharge pause period by the driving cycle of the ink jet printer head, and the pre-discharge voltage waveform is determined or selected based on the calculated discharge pause cycle number.

40. A machine-readable record medium as claimed in claim 37, wherein the pre-discharge voltage waveform is applied to the electric-mechanical transducer just before the restart of the application of the discharge voltage waveform after the discharge pause period.

41. A machine-readable record medium as claimed in claim 40, wherein the pre-discharge voltage waveform is applied to the electric-mechanical transducer a printer head driving cycle before the restart of the application of the discharge voltage waveform.

42. A machine-readable record medium as claimed in claim 40, wherein the pre-discharge voltage waveform is applied to the electric-mechanical transducer two printer head driving cycles before the restart of the application of the discharge voltage waveform.

43. A machine-readable record medium as claimed in claim 37, wherein in the pre-discharge voltage waveform determination step, the determination or selection of the pre-discharge voltage waveform is executed so that ink meniscus vibration due to the application of the pre-discharge voltage waveform will be attenuated enough before the restart of the application of the discharge voltage waveform.

44. A machine-readable record medium as claimed in claim 37, wherein in the pre-discharge voltage waveform, the voltage is gradually increased from the bias voltage of the electric-mechanical transducer during the discharge pause period so as to decrease the volume of the ink chamber gradually and thereafter returned to the bias voltage just before the restart of the application of the discharge voltage waveform.

45. A machine-readable record medium as claimed in claim 37, wherein in the pre-discharge voltage waveform, the voltage is gradually decreased from the bias voltage of the electric-mechanical transducer during the discharge pause period so as to increase the volume of the ink chamber gradually and thereafter returned to the bias voltage just before the restart of the application of the discharge voltage waveform.

46. A machine-readable record medium as claimed in claim 45, wherein the pre-discharge voltage waveform in the return to the bias voltage is set so that ink drop discharge will not be caused by decrease of the volume of the ink chamber.

47. A machine-readable record medium as claimed in claim 37, wherein in the pre-discharge voltage waveform, the voltage is decreased below the bias voltage of the electric-mechanical transducer so as to increase the volume of the ink chamber and thereafter returned to the bias voltage just before the restart of the application of the discharge voltage waveform.

48. A machine-readable record medium as claimed in claim 47, wherein voltage difference in the pre-discharge voltage waveform is set based on the length of the discharge pause period.

49. A machine-readable record medium as claimed in claim 37, wherein in the pre-discharge voltage waveform, the voltage is increased above the bias voltage of the electric-mechanical transducer so as to decrease the volume of the ink chamber and thereafter returned to the bias voltage just before the restart of the application of the discharge voltage waveform.

50. A machine-readable record medium as claimed in claim 49, wherein voltage difference in the pre-discharge voltage waveform is set based on the length of the discharge pause period.

51. A machine-readable record medium as claimed in claim 37, wherein in the pre-discharge voltage waveform, the voltage is first decreased below the bias voltage of the electric-mechanical transducer so as to increase the volume of the ink chamber and thereafter increased above the bias voltage.

52. A machine-readable record medium as claimed in claim 37, wherein in the pre-discharge voltage waveform, the voltage is first increased above the bias voltage of the electric-mechanical transducer so as to decrease the volume of the ink chamber and thereafter decreased below the bias voltage.

53. A machine-readable record medium as claimed in claim 37, wherein in the pre-discharge voltage waveform, the voltage is decreased below the bias voltage of the electric-mechanical transducer so as to increase the volume of the ink chamber and returned to the bias voltage for N times just before the restart of the application of the discharge voltage waveform, in which the number N is determined in the pre-discharge voltage waveform determination step depending on the length of the discharge pause period.

54. A machine-readable record medium as claimed in claim 37, wherein in the pre-discharge voltage waveform, the voltage is increased above the bias voltage of the electric-mechanical transducer so as to decrease the volume of the ink chamber and returned to the bias voltage for N times just before the restart of the application of the discharge voltage waveform, in which the number N is determined in the pre-discharge voltage waveform determination step depending on the length of the discharge pause period.

* * * * *